US009732474B2

(12) United States Patent
Koenig et al.

(10) Patent No.: US 9,732,474 B2
(45) Date of Patent: Aug. 15, 2017

(54) HYDROPHOBIC COATED PAPER SUBSTRATE FOR POLYMER EMULSION TOPCOATS AND METHOD FOR MAKING SAME

(71) Applicant: INTERNATIONAL PAPER COMPANY, Memphis, TN (US)

(72) Inventors: Michael F. Koenig, Paducah, KY (US); David V. Reed, Jamestown, OH (US)

(73) Assignee: International Paper Company, Memphis, TN (US)

( * ) Notice: Subject to any disclaimer, the term of this patent is extended or adjusted under 35 U.S.C. 154(b) by 321 days.

(21) Appl. No.: 14/725,876

(22) Filed: May 29, 2015

(65) Prior Publication Data

US 2016/0348318 A1 Dec. 1, 2016

(51) Int. Cl.

| | |
|---|---|
| ***D21H 19/80*** | (2006.01) |
| ***D21H 19/12*** | (2006.01) |
| ***D21H 27/10*** | (2006.01) |
| ***D21H 17/62*** | (2006.01) |
| ***D21H 19/40*** | (2006.01) |
| ***D21H 19/48*** | (2006.01) |
| ***D21H 19/54*** | (2006.01) |
| ***D21H 19/82*** | (2006.01) |
| ***D21H 21/16*** | (2006.01) |

(52) U.S. Cl.

CPC ..... *D21H 19/80* (2013.01); *D21H 17/62* (2013.01); *D21H 19/12* (2013.01); *D21H 19/40* (2013.01); *D21H 19/48* (2013.01); *D21H 19/54* (2013.01); *D21H 19/822* (2013.01); *D21H 21/16* (2013.01); *D21H 27/10* (2013.01)

(58) Field of Classification Search

CPC ..... D21H 19/80; D21H 17/62; D21H 19/12; D21H 19/40; D21H 19/48; D21H 19/54; D21H 19/822; D21H 21/16; D21H 27/10

USPC ..... 428/537.5

See application file for complete search history.

(56) References Cited

U.S. PATENT DOCUMENTS

| | | | | |
|---|---|---|---|---|
| 2,961,419 | A | 11/1960 | Cohen et al. | |
| 2,994,677 | A | 8/1961 | Bohnert et al. | |
| 3,260,690 | A | 7/1966 | Bohnert et al. | |
| 3,922,244 | A | 11/1975 | Stephens et al. | |
| 3,949,138 | A | 4/1976 | Heiser | |
| RE29,272 | E | 6/1977 | Hintz et al. | |
| 4,168,779 | A | 9/1979 | Yokokoji et al. | |
| 4,206,249 | A | 6/1980 | Suzuki et al. | |
| 4,543,280 | A | 9/1985 | Fujita et al. | |
| 5,626,945 | A | 5/1997 | Berzins et al. | |
| 5,654,039 | A | 8/1997 | Wenzel et al. | |
| 5,763,100 | A | 6/1998 | Quick et al. | |
| 5,851,651 | A * | 12/1998 | Chao | B41M 5/52 347/105 |
| 5,911,904 | A | 6/1999 | Shih et al. | |
| 5,919,558 | A * | 7/1999 | Chao | B41M 5/508 428/32.18 |
| 5,935,664 | A | 8/1999 | Claytor et al. | |
| 6,066,375 | A | 5/2000 | Shanton | |
| 6,087,457 | A * | 7/2000 | Tsai | D21H 21/16 162/135 |
| 6,290,814 | B1 | 9/2001 | Rooff et al. | |
| 6,764,726 | B1 | 7/2004 | Yang et al. | |
| 6,893,693 | B2 | 5/2005 | Swoboda et al. | |
| 7,025,908 | B1 | 4/2006 | Hayashi et al. | |
| 7,176,349 | B1 | 2/2007 | Dhugga et al. | |
| 7,208,535 | B2 | 4/2007 | Asrar et al. | |
| 7,267,794 | B2 | 9/2007 | Amick | |
| 7,276,361 | B2 | 10/2007 | Doi et al. | |
| 7,435,483 | B2 * | 10/2008 | Lee | C08L 77/00 427/314 |
| 7,682,487 | B2 | 3/2010 | Sundberg et al. | |
| 7,943,789 | B2 * | 5/2011 | Goldsberry, III | D06M 13/192 106/238 |
| 8,277,611 | B2 | 10/2012 | Sinkko et al. | |
| 8,329,268 | B2 | 12/2012 | Bell et al. | |
| 8,586,156 | B2 * | 11/2013 | Koenig | B41M 5/52 428/32.21 |
| 8,685,503 | B2 | 4/2014 | Zhou et al. | |
| 8,758,567 | B2 | 6/2014 | Brungardt | |
| 8,795,796 | B2 * | 8/2014 | Koenig | B41M 5/52 428/32.21 |
| 8,840,759 | B2 * | 9/2014 | Benz | D21H 17/16 162/158 |
| 9,034,953 | B2 * | 5/2015 | Zhou | B41M 5/0035 106/156.23 |
| 9,145,646 | B2 * | 9/2015 | Benz | D21H 17/16 |

(Continued)

FOREIGN PATENT DOCUMENTS

| | | |
|---|---|---|
| AU | 2002306037 | 5/2003 |
| CA | 2140655 | 7/1998 |
| CN | 101575825 | 11/2009 |
| CN | 201648861 | 11/2010 |
| CN | 102251437 | 12/2012 |

(Continued)

OTHER PUBLICATIONS

Hercules, A synergy of integrated pulp and paper solutions, 2000.
Kreglinger Europe, Scripset Product details, 2009.
G.A. Smook, Handbook for Pulp and Paper Technologists, Angus Wild Publication, 2nd Edition, 1992, pp. 60-65, 221-222, 342, 273-278, 283-285.

*Primary Examiner* — Leszek Kiliman
(74) *Attorney, Agent, or Firm* — Thomas W. Ryan, III; Eric W. Guttag

(57) ABSTRACT

A hydrophobic coated paper substrate formed from a paper substrate of paper fibers and internal sizing agent, a surface size layer of one or more surface sizing starches, optionally one or more non-starch hydrophobic surface sizing agents, and optionally one or more paper pigments, on at least one surface of the paper substrate, and at least one hydrophobic pigmented coating layer of a paper pigment component and a hydrophobic pigment binder component on at least one surface size layer. Also a method for preparing such coated paper substrates.

37 Claims, 3 Drawing Sheets

(56) References Cited

U.S. PATENT DOCUMENTS

| | | | |
|---|---|---|---|
| 2004/0091585 | A1 | 5/2004 | Theisen et al. |
| 2004/0121079 | A1 | 6/2004 | Urscheler et al. |
| 2004/0221976 | A1 | 11/2004 | Williams et al. |
| 2008/0241483 | A1 | 10/2008 | Bverhoeven et al. |
| 2008/0277084 | A1 | 11/2008 | Denowski et al. |
| 2009/0020224 | A1 | 1/2009 | Nowak et al. |
| 2009/0152268 | A1 | 6/2009 | Whiteman et al. |
| 2009/0297842 | A1 | 12/2009 | Akiyama |
| 2009/0298975 | A1 | 12/2009 | Nitzman et al. |
| 2010/0178523 | A1 | 7/2010 | Iyengar et al. |
| 2011/0025387 | A1 | 2/2011 | Lamanna et al. |
| 2011/0104407 | A1 | 5/2011 | Zhou |
| 2011/0132975 | A1 | 6/2011 | Toft et al. |
| 2011/0138753 | A1 | 6/2011 | Justice et al. |
| 2011/0262745 | A1 | 10/2011 | Ronka |
| 2012/0114916 | A1 | 5/2012 | Anderson et al. |
| 2013/0101855 | A1 | 4/2013 | Cham et al. |
| 2014/0120277 | A1 | 5/2014 | Vonfelden |
| 2015/0111011 | A1 | 4/2015 | Hoekstra et al. |

FOREIGN PATENT DOCUMENTS

| | | |
|---|---|---|
| CN | 103061205 | 4/2013 |
| DE | 19541681 | 9/1996 |
| EP | 1228889 | 1/2002 |
| EP | 2682523 | 1/2014 |
| EP | 2719825 | 4/2014 |
| EP | 2777934 | 9/2014 |
| EP | 2545102 | 12/2014 |
| GB | 1234880 | 7/1969 |
| JP | 200417984 | 1/2004 |
| JP | 2009263855 | 11/2009 |
| JP | 2009270220 | 11/2009 |
| JP | 4513153 | 5/2010 |
| JP | 2015030955 | 2/2015 |
| WO | 2005044469 | 5/2005 |
| WO | 2005062825 | 7/2005 |
| WO | 2006073342 | 7/2006 |
| WO | PCT-2011/093896 | 8/2011 |
| WO | 2014148685 | 9/2014 |
| WO | 2015020749 | 2/2015 |

* cited by examiner

HYDROPHOBIC COATED PAPER SUBSTRATE FOR POLYMER EMULSION TOPCOATS AND METHOD FOR MAKING SAME

FIELD OF THE INVENTION

The present invention broadly relates to hydrophobic coated paper substrates suitable for aqueous polymer emulsion topcoats to form a moisture barrier coating layer, and which may be repulpable/recyclable for greater suitability for use with papermaking machines. The present invention also broadly relates to a method for preparing such hydrophobic coated paper substrates.

BACKGROUND

Paper substrates have been used as disposable, single use containers, packaging, etc., for a variety of food and beverage products. For example, paperboard in the form of cupstock may be used to provide disposable, single use cups for a variety of beverage products. These disposable, single use cups may be used for "hot" beverages such as coffee, lattes, mochas, hot chocolate, etc., as well as for "cold" beverages such soft drinks, milk, slushes, smoothies, etc. Packaging such as these disposable, single use cups may also be used as containers for other moisture-containing food products such as ice cream, other frozen foods, soup, etc., as well as other wet and dry food packages, non-food packaging such as soap boxes, etc.

Moisture from such moisture-containing food and beverage products may penetrate the cupstock from which the cup is formed, thereby causing the cup to become soggy and thus lose structural integrity. In the case of "cold" beverage or food products, moisture may also condense on the side or surface away from the beverage or food, thus also penetrating into the cupstock. To inhibit such moisture penetration, the cupstock of such cups may be coated on one or both sides/surfaces with a water-repellant material. Conventional water-repellant coatings may include natural or synthetic waxes. Alternatively, a water-repellent polymer coating such as polyethylene may be applied to, laminated on, or extruded on or both of the sides/surfaces of the cupstock. Such water-repellant coatings may improve the water resistance of the cupstock used in disposable single-use cups and thus improve or increase the structural integrity of such cups when containing either "hot" beverage or food products such as coffee, soup, etc., as well "cold" beverage or food products such as soft drinks, ice cream, etc.

SUMMARY

According to a first broad aspect of the present invention, there is provided an article comprising a hydrophobic coated paper substrate comprising:

- a paper substrate having a first surface and a second surface, the paper substrate comprising:
  - at least about 70% by weight of the paper substrate of paper fibers; and
  - an internal paper sizing agent in an amount sufficient to impart to the paper substrate an HST value of at least about 200 seconds; and
- a surface size layer on at least one of the first and second surfaces, the surface size layer being present in an amount of at least about 1 lbs/3000 $ft^2$ (3 msf) of the paper substrate and comprising one or more surface sizing starches in an amount of at least about 1 lbs/3000 $ft^2$ (3 msf);
- at least one hydrophobic pigmented coating layer on at least one surface size layer to impart a Cobb value of about 50 gsm or less per 2 minutes, the hydrophobic pigmented coating layer having a Parker Print Smoothness value of less than about 3, and being present on at least one surface size layer in a coat weight of from about 2 to about 20 lbs/3000 $ft^2$ (3 msf) of the paper substrate, the hydrophobic pigmented coating layer comprising:
  - a paper pigment component in an amount of from about 20 to about 90% by weight of the hydrophobic pigmented coating layer, the paper pigment component comprising from about 20 to 100 parts of a platy mineral pigment and from 0 to about 80 parts of a non-platy paper pigment; and
  - a hydrophobic pigment binder component in an amount of from about 10 to about 400 parts per 100 parts of the paper pigment component, the hydrophobic pigment binder component comprising one or more hydrophobic polymers.

According to a second broad aspect of the present invention, there is provided a method for preparing a hydrophobic coated paper substrate, which comprises the following steps:

(a) providing a paper substrate having a first surface and a second surface, at least one of the first and second surfaces having a surface size layer in an amount of at least about 1 lbs/3000 $ft^2$ (3 msf) of the paper substrate, the paper substrate comprising:
  - at least about 70% by weight of the paper substrate of paper fibers; and
  - an internal paper sizing agent in an amount sufficient to impart to the paper substrate an HST value of at least about 200 seconds;
- the surface size layer comprising one or more surface sizing starches in an amount of at least about 1 lbs/3000 $ft^2$ (3 msf); and (b) applying a hydrophobic pigmented coating composition to at least one surface size layer to form at least one hydrophobic pigmented coating layer having a Parker Print Smoothness value of less than about 3 on the surface size layer and a Cobb value of about 50 gsm or less per 2 minutes, the hydrophobic pigmented coating composition being applied in a coat weight of from about 2 to about 20 lbs/3000 $ft^2$ (3 msf) of the paper substrate, the hydrophobic pigmented coating composition comprising:
  - a paper pigment component in an amount of from about 20 to about 90% by weight in the hydrophobic pigmented coating composition, and comprising from about 20 to 100 parts of a platy mineral pigment and from 0 to about 80 parts of a non-platy paper pigment; and
  - a hydrophobic pigment binder component in an amount of from about 10 to about 400 parts per 100 parts of the paper pigment component, the hydrophobic pigment binder component comprising one or more hydrophobic polymers.

BRIEF DESCRIPTION OF THE DRAWINGS

The invention will be described in conjunction with the accompanying drawings, in which.

DETAILED DESCRIPTION

Figure 1:
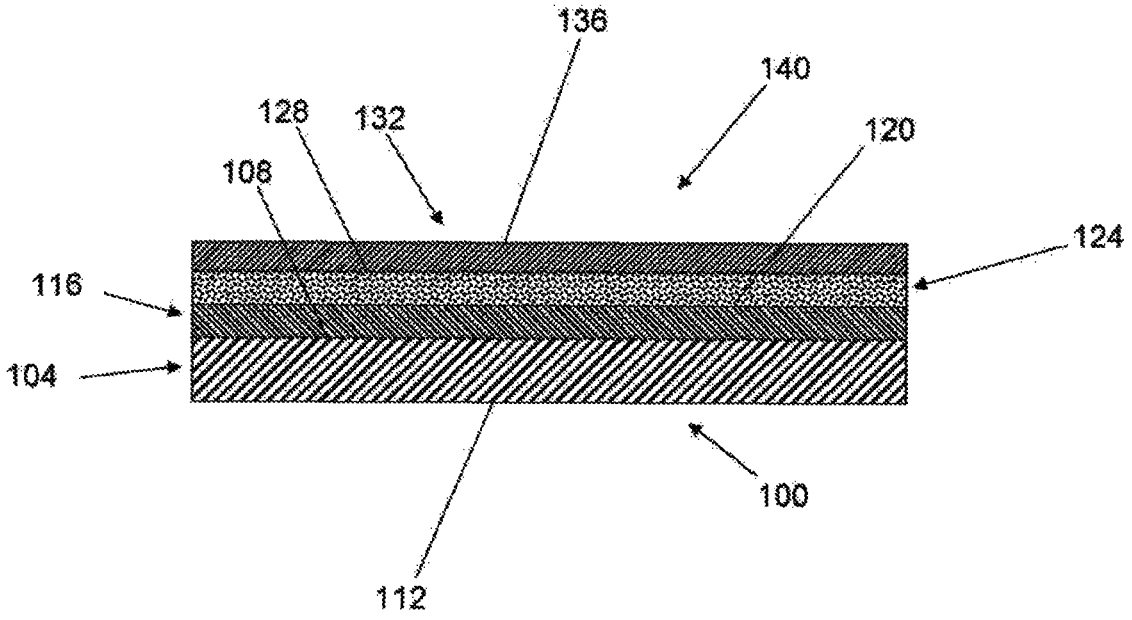
FIG. 1 represents a sectional view of an embodiment of a hydrophobic coated paper substrate, as well as a moisture barrier coated paper substrate according to the present invention having a hydrophobic coating layer/moisture barrier coating layer on one surface/side of the paper substrate.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, the term "paper substrate" refers to a fibrous paper web that may be formed, created, produced, etc., from a mixture, furnish, etc., comprising paper fibers, internal sizing agents, etc., plus any other optional papermaking additives such as, for example, paper fillers, wet-strength agents, optical brightening agents, etc. The paper substrate may be in the form of a continuous roll, a discrete sheet, etc.

For the purposes of the present invention, the term "paper fibers" refers to any fibrous material which may be used in preparing a fibrous paper web. Paperboard making fibers may include pulp (wood) fibers (e.g., softwood fibers and/or hardwood fibers), kraft fibers (e.g., pulp fibers produced by the kraft pulping process), as well as wood fibers produced by soda, sulfite, magnefite, cold soda, NSSC, etc., pulp making processes, synthetic fibers, waste paper fibers, recycled paper fibers, fibers from any of hemp, jute, ramie, flax, cotton linters, abaca, wood waste, straw, bagasse, bamboo, sisal, synthetic (e.g., bicomponent) fibers, etc., as well as any combinations of such fibers.

For the purposes of the present invention, the term "paperboard" refers to paper substrate comprising a single ply (layer) of a paperboard having a caliper of from about 8 to about 28 mils (points), such as from about 12 to about 24 mils (points). The paperboard may be in the form of a continuous roll, a discrete sheet, a packaging material blank such as for making a cup, etc.

For the purposes of the present invention, the term "softwood fibers" refers to fibrous pulps derived from the woody substance of coniferous trees (gymnosperms) such as varieties of fir, spruce, pine, etc., for example, loblolly pine, slash pine, Colorado spruce, balsam fir, Douglas fir, jack pine, radiata pine, white spruce, lodgepole pine, redwood, etc. North American southern softwoods and northern softwoods may be used to provide softwood fibers, as well as softwoods from other regions of the world. Inclusion of softwood fibers tends to impart greater bending stiffness in paper substrates such as paperboards, but also tends to impart rougher and less smooth surfaces in paper substrates, such as paperboards.

For the purposes of the present invention, the term "hardwood fibers" refers to fibrous pulps derived from the woody substance of deciduous trees (angiosperms) such as birch, oak, beech, maple, eucalyptus, poplars, etc. Inclusion of hardwood fibers in paper substrates such as paperboards tends to impart smoother surfaces in paper substrates, such as paperboards.

For the purposes of the present invention, the term "CTMP fibers" refers to chemithermomechanical pulp (CTMP) fibers which have subjected to a combination of chemical, thermal, and mechanical treatment. As used herein, CTMP fibers refer to fibers which have been treated by chemical, thermal, and mechanical treatment in any order of such treatments, including chemi-thermo-mechanical (C-T-M) pulp fibers, thermo-chemi-mechanical (T-C-M) pulp fibers, thermo-mechanical-chemi (T-M-P) pulp fibers, long fiber chemi-mechanical pulp/chemically treated long pulp fibers (LFCMP/CTLF), etc. See G. A. Smook, Handbook for Pulp and Paper Technologists ($2^{nd}$ Edition, 1992), pages 60-65, the entire contents and disclosure of which is herein incorporated by reference, for a general description of chemithermomechanical pulping (CTMP) for preparing CTMP fibers.

For the purposes of the present invention, the term "bleached CTMP fibers (also referred to interchangeably as BCTMP fibers" refers to chemithermomechanical pulp (CTMP) fibers which have subjected to one or more bleaching treatments.

For the purposes of the present invention, the term "synthetic fibers" refers to fibers other than wood pulp fibers (e.g., other than pulp fibers) and which may be made from, for example, cellulose acetate, acrylic, polyamides (such as, for example, Nylon 6, Nylon 6/6, Nylon 12, polyaspartic acid, polyglutamic acid, etc.), polyamines, polyimides, polyamides, polyacrylics (such as, for example, polyacrylamide, polyacrylonitrile, esters of methacrylic acid and acrylic acid, etc.), polycarbonates (such as, for example, polybisphenol A carbonate, polypropylene carbonate, etc.), polydienes (such as, for example, polybutadiene, polyisoprene, polynorbomene, etc.), polyepoxides, polyesters (such as, for example, polyethylene terephthalate, polybutylene terephthalate, polytrimethylene terephthalate, polycaprolactone, polyglycolide, polylactide, polyhydroxybutyrate, polyhydroxyvalerate, polyethylene adipate, polybutylene adipate, polypropylene succinate, etc.), polyethers (such as, for example, polyethylene glycol(polyethylene oxide), polybutylene glycol, polypropylene oxide, polyoxymethylene (paraformaldehyde), polytetramethylene ether(polytetrahydrofuran), polyepichlorohydrin, and so forth), polyfluorocarbons, formaldehyde polymers (such as, for example, urea-formaldehyde, melamine-formaldehyde, phenol formaldehyde, etc.), polyolefins (such as, for example, polyethylene, polypropylene, polybutylene, polybutene, polyoctene, etc.), polyphenylenes (such as, for example, polyphenylene oxide, polyphenylene sulfide, polyphenylene ether sulfone, etc.), silicon containing polymers (such as, for example, polydimethyl siloxane, polycarbomethyl silane, etc.), polyurethanes, polyvinyls (such as, for example, polyvinyl butyral, polyvinyl alcohol, esters and ethers of polyvinyl alcohol, polyvinyl acetate, polystyrene, polymethylstyrene, polyvinyl chloride, polyvinyl pyrrolidone, polymethyl vinyl ether, polyethyl vinyl ether, polyvinyl methyl ketone, etc.), polyacetals, polyarylates, and copolymers (such as, for example, polyethylene-co-vinyl acetate, polyethylene-co-acrylic acid, polybutylene terephthalate-co-polyethylene terephthalate, polylauryllactam-block-polytetrahydrofuran, vinyl chloride, regenerated cellulose such as viscose rayon, glass fibers, ceramic fibers, bicomponent fibers, melamine fibers (e.g., fibers obtained from melamine-formaldehyde resin), etc.

For the purposes of the present invention, the term "bicomponent fibers" refers to synthetic fibers comprising a core and sheath configuration. The core and sheath portions of these bicomponent fibers may be made from various polymers. For example, bicomponent fibers may comprise a PE (polyethylene) or modified PE sheath which may have a PET (polyethylene terephthalate) or PP (polypropylene) core. In one embodiment, the bicomponent fiber may have a core made of polyester and sheath made of polyethylene. Alternatively, a multi-component fiber with a PP (polypropylene) or modified PP or PE sheath or a combination of PP and modified PE as the sheath or a copolyester sheath wherein the copolyester is isophthalic acid modified PET (polyethylene terephthalate) with a PET or PP core, or a PP sheath-PET core and PE sheath-PP core and co-PET sheath fibers may be employed. Various geometric configurations may be used for the bicomponent fiber, including concentric, eccentric, islands-in-the-sea, side-by-side, etc. The relative weight percentages and/or proportions of the core and sheath portions of the bicomponent fiber may also be varied.

For the purposes of the present invention, the term "paper filler" refers to inorganic materials, which may be in particulate form, which may lower the cost (per weight) of the paper substrate, etc. Paper fillers which may used in embodiments of the present invention may include, for example, calcium carbonate, magnesium carbonate, calcium hydroxide, calcium aluminate, magnesium carbonate mica, silica, alumina, sand, gravel, sandstone, limestone, crushed rock, bauxite, granite, limestone, glass beads, aerogels, xerogels, fly ash, fumed silica, fused silica, tabular alumina, kaolin, microspheres, hollow glass spheres, porous ceramic spheres, ceramic materials, pozzolanic materials, zirconium compounds, xonotlite (a crystalline calcium silicate gel), lightweight expanded clays, perlite, vermiculite, hydrated or unhydrated hydraulic cement particles, pumice, zeolites, exfoliated rock, etc., and mixtures thereof. Certain paper fillers such as calcium carbonate, may also function as paper pigments.

For the purposes of the present invention, the term "internal paper sizing agents" refers to sizing agents which are included, added, etc., during the papermaking process before a fibrous paper substrate is formed. Internal paper sizing agents generally resist penetration of water or other liquids into the paper substrate by making the paper substrate more hydrophobic. Suitable internal paper sizing agents may include nonreactive surface sizing agents and reactive surface sizing agents.

For the purposes of the present invention, the term "nonreactive internal sizing agents" (also referred to interchangeably as "bulk internal sizing agents") refer to internal surface sizing agents which are retained by the paper substrate primarily due to precipitation and electrostatic attraction to the paper fibers, and may be more suitable for acid-made paper substrates (i.e., paper substrates made from a paper fiber furnish having a pH value in, for example, the range of from about 3.5 to about 6.5, and which may be in the presence of an aluminum species, e.g. alum). Nonreactive internal surface sizing agents may include, for example, one or more of: rosin-based sizes (e.g., sizes formed from rosin acids isolated from the "tall oil" produced during kraft pulping of softwood species and which contain abietic acid and related compounds, and which may be treated with fumaric acid to convert at least some of the abietic acid and related compounds to tricarboxylic species referred to as "fortified rosin") such as rosin emulsion sizes (i.e., rosin acids dissolved, dispersed, diluted, etc., with an emulsifier or stabilizer such as casein or other cationic polyelectrolyte to form a liquid), rosin soap sizes (e.g., salts of rosin acids which may be "set" in the presence of aluminum species, such as alum, to provide a water-soluble or water-dispersible solid); wax emulsion sizes (e.g., wax particles, such as from polyethylene (PE), polypropylene (PP), carnuba, other natural or synthetic waxes, etc, suspended in an aqueous (water) phase); etc. See G. A. Smook, Handbook for Pulp and Paper Technologists ($2^{nd}$ Edition, 1992), page 221, the entire contents and disclosure of which is herein incorporated by reference, for a general description of rosin sizes and other nonreactive internal sizing agents.

For the purposes of the present invention, the term "reactive internal sizing agents" refers to internal sizing agents which are retained by the paper substrate through reaction with the paper fibers, and may be more suitable for alkaline-made paper substrates (i.e., paper substrates made from a paper fiber furnish having a pH value in, for example, the range of from about 7 to about 9). Reactive internal size agents may include one or more of: alkyl ketene dimers (AKDs); alkenyl succinic acid anhydrides (ASAs), etc. See G. A. Smook, Handbook for Pulp and Paper Technologists ($2^{nd}$ Edition, 1992), page 222, the entire contents and disclosure of which is herein incorporated by reference, for a general description of reactive internal size agents.

For the purposes of the present invention, the term "surface sizing starch" refers to surface sizing agents for paper substrates which comprise one or more natural starches (i.e., unmodified starches obtained from plant sources such as maize, wheat, rice, potato, tapioca, etc.) such as cereal starches (e.g., corn starch, wheat starch, rice starch, potato starch, oat starch, rye starch, barley starch, millet sorghum starch, etc.) and non-cereal starches (e.g., tapioca starch, etc.), modified natural starches (e.g., ethylated starches, oxidized starches, such as oxidized corn starch, etc.), or combinations thereof. Modified starches (e.g., oxidized starches such as oxidized corn starch) may be obtained by one or more chemical treatments known in the paper sizing starch art, for example, by oxidation to convert some of —$CH_2OH$ groups to —COOH groups, etc. In some cases the modified starch may have a small proportion of acetyl groups. Alternatively, the starch may be chemically modified to render it cationic (i.e., a cationic starch) or amphoteric (i.e., an amphoteric starch), i.e., with both cationic and anionic charges. The modified starches may also include starches converted to a starch ether, or a hydroxyalkylated starch by replacing some —OH groups with, for example, —$OCH_2CH_2OH$ groups (i.e., a hydroxyethylated starch), -OCH2$CH_3$ groups (i.e., an ethylated starch), —$OCH_2CH_2CH_2OH$ groups (i.e., a propylated starch), etc.

For the purposes of the present invention, the term "non-starch hydrophobic surface sizing agent" refers to surface sizing agents other than surface sizing starches which may be optionally included in the surface size layer applied on, added to, etc., the surface of the formed fibrous paper substrate. Non-starch surface hydrophobic sizing agents generally resist penetration of water or other liquids (e.g., by providing water hold out) into the paper substrate by covering the paper substrate with a more hydrophobic film to, example: (1) limit penetration of the subsequently applied hydrophobic pigmented coating (HPC) layer into the paper substrate when the HPC layer is applied, so less of the HPC is lost in the interior of the paper substrate, and (2) by contributing to the water barrier (holdout) properties of the paper substrate, the surface sizing layer may contribute to the benefits provided by the HPC layer, thus meaning thinner HPC layer may be required to achieve the same or similar Cobb values (as defined below). Suitable non-starch hydrophobic surface sizing agents may be, for example, anhydrides, dimers, polymers, copolymers, polymer latexes, etc., and may include, for example, one or more of: styrene-maleic anhydride (SMA) copolymers; styrene-acrylic (SA) copolymers, such as styrene-acrylic acid (SAA) copolymers; alkylated melamines; rosin-based sizes (e.g., rosin emulsion sizes, rosin soap sizes, etc.); styrene-butadiene (SB) copolymers; acrylonitrile-butadiene (AB) copolymers; alkyl ketene dimers (AKDs); polyacrylamides polymers or copolymers; etc.

For the purpose of the present invention, the term "Hercules Sizing Test" or "HST" refers to a test of resistance to penetration of, for example, an acidic water solution through paper. The HST may be measured using the procedure of TAPPI Standard Method 530 pm-89. See U.S. Pat. No. 6,764,726 (Yang et al.), issued Jul. 20, 2004, the entire disclosure and contents of which is hereby incorporated by reference. The HST value is measured following the conventions described in TAPPI Standard Method number T-530 pm-89, using a 30% formic acid ink and an 80% reflectance endpoint. The HST value measured reflects the relative level of sizing agent present in and/or on the paper substrate.

For the purposes of the present invention, the term "paper pigments" refers to mineral pigments (e.g., calcium carbonate, clay (e.g., kaolin clay), talc, etc.), as well as non-mineral materials (e.g., plastic pigments, etc.), which may be used in paper making to reduce materials cost per unit mass of the paper substrate, increase opacity, increase smoothness, etc. The mineral pigments may be finely divided, for example, in the size range of from about 0.5 to about 5 microns, may be platy mineral pigments, etc.

For the purposes of the present invention, the term "platy mineral pigment" refers to mineral (paper) pigments which are plate-like in structure and consist of thin, ill-formed, sheet-like particles of high aspect ratio (width to thickness of the particles) of greater than about 2, for example, greater than about 5, such as in the range of from about 10 to about 60 (e.g., from about 20 to about 40). Platy mineral pigments may include one or more of: delaminated clays, kaolin, talc, montmorillonite, halloysite, attapulgite, illite, natural and synthetic micas, such as muscovite, phlogopite, biotite, barium disilic, etc. See commonly-assigned U.S. Pat. No. 7,320,825 (Morabito), issued Jan. 22, 2008, the entire contents and disclosure of which is herein incorporated by reference, for description of platy mineral pigments, and the difference from non-platy mineral pigments.

For the purposes of the present invention, the term "non-platy paper pigments" refers to mineral pigments (e.g., calcium carbonate, etc.), as well as non-mineral pigments (e.g., plastic pigments, etc.) which a not plate-like in structure and which may comprise finely divided particles. Non-platy pigments may include one or more of: calcium carbonate pigments (including GCC, PCC, etc.); titanium dioxide pigments; barium sulfate pigments; silica pigments; zeolite pigments; plastic pigments; etc.

For the purposes of the present invention, the term "calcium carbonate" refers various calcium carbonates which may be used as paper pigments, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may be used as a paper pigment. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated.

For the purposes of the present invention, the term "basis weight" refers to the grammage of a sheet, roll, etc., of material comprising the paper substrate, with or without layers or coatings, as determined by TAPPI test T410. See G. A. Smook, Handbook for Pulp and Paper Technologists ($2^{nd}$ Edition, 1992), page 342, Table 22-11, the entire contents and disclosure of which is herein incorporated by reference, which describes the physical test for measuring basis weight. The basis weight of the paper substrate is essentially a measure of the density of that paper substrate per unit area, herein reflected in units of lbs/3000 $ft^2$ (3 msf). Suitable basis weights for use herein are in the range of from about 105 to about 300 lbs/3000 $ft^2$ (3 msf), such as from about 140 to about 250 lbs/3000 $ft^2$ (3 msf).

For the purposes of the present invention, the term "caliper," refers to the thickness of a sheet, web, substrate, etc., of a material, for example, a material comprising the paper web, paper substrate, etc., with or without layers, coatings, etc., before or after calendaring, in mils, as determined by measuring the distance between smooth, flat plates at a defined pressure.

For the purposes of the present invention, the term "mil(s)" is used in the conventional sense of referring to thousandths of an inch and is also referred to interchangeably herein as "points."

For the purposes of the present invention, the term "MD" refers to machine direction of the paper substrate, i.e., is used in the conventional papermaking sense of the direction the paper substrate moved during its formation.

For the purposes of the present invention, the term "CD" refers to the cross-machine direction, i.e., is used in the conventional papermaking sense of the direction transverse (e.g., orthogonal) to the machine direction (MD).

For the purposes of the present invention, the term "solids basis" refers to the weight percentage (or parts) of each of the respective solid materials (e.g., paper fibers, internal sizing agents, surface sizing agents, paper pigments, coating materials, polymers, etc.) present in the composition, etc., in the absence of any liquids (e.g., water, other solvents, etc.). Unless otherwise specified, all percentages and parts given herein for the solid materials are on a solids basis.

For the purposes of the present invention, the term "lbs/3000 $ft^2$ (used interchangeably with the term lbs/3 msf)" refers to the amount (in lbs) of the composition, compound, layer, component, material, etc., per unit of surface area (in 3000 $ft^2$ or 3 msf) of the one side, surface, etc., of the layer, paper substrate, coating, etc., that the composition, compound, layer, component, material, etc., is applied to, on, etc.

For the purposes of the present invention, the term "solids content" refers to the percentage of non-volatile, non-liquid components (by weight) that are present in the composition, etc.

For the purpose of the present invention, the term "applying" with reference to the coatings, and compositions used to provide such coatings, may include adding, depositing, spraying, daubing, spreading, wiping, dabbing, dipping, printing, etc.

For the purposes of the present invention, the term "Cobb value" refers to a measure of water absorptiveness by the paper substrate/coated paper substrate. Cobb values reflect the mass of water absorbed in a specific period of time by a 1 $m^2$ sample of the paper substrate/coated paper substrate under specified conditions by a standard test method such TAPPI T-441. For embodiments of the coated paper substrates of the present invention, Cobb values may be measured in periods of 2 minutes or 30 minutes depending upon the coated paper substrate involved.

For the purposes of the present invention, the term "paper smoothness" refers to the extent to which the paper substrate surface, size surface layer surface, coating surface, etc., deviates from a planar or substantially planar surface, as affected by the depth of the paper substrate/coating layer, paper substrate/coating layer width, numbers of departure from that planar surface, etc. Paper smoothness may be measured in terms of Parker Print Smoothness (PPS) according to TAPPI test method T 555 om-99 at a clamping pressure of 10 $kgf/cm^2$. Parker Print Smoothness (PPS) values reflect the degree of "microroughness" of the paperboard or coating surface. The higher the Parker Print Smoothness value, the rougher the paper substrate surface, coating surface, etc. Conversely, the lower PPS value, the smoother the paper substrate surface, coating surface, etc. Paper smoothness may be also measured in terms of Sheffield smoothness values. Sheffield smoothness values may be measured by TAPPI test method T 538 om-01, in Sheffield Units (SUs).

For the purposes of the present invention, the term "liquid" refers to a non-gaseous fluid composition, compound, material, etc., which may be readily flowable at the temperature of use (e.g., room temperature) with little or no tendency to disperse and with a relatively high compressibility.

For the purposes of the present invention, the term "room temperature" refers to the commonly accepted meaning of room temperature, i.e., an ambient temperature of 20° to 25° C.

For the purposes of the present invention, the term "surface size composition" (also referred to in certain embodiments as a "size press composition") refers to a size composition comprising: one or more surface sizing starches; optionally one or more non-starch hydrophobic surface sizing agents; optionally one or more paper pigments, etc., as well as one or more other optional ingredients such as pigment binders (e.g., polyvinyl alcohol, polyvinyl acetate, polyvinyl pyrrolidone polymers or copolymers, etc.), cross-linkers (e.g., glyoxals, ammonium zirconium carbonate (AZC), potassium zirconium carbonate (KZC), etc.), rheology modifiers, defoamers, etc.

For the purposes of the present invention, the term "surface size layer" (also referred to in some embodiments as "size press layer") refers to one or more layers formed on (i.e., adjacent to) one or both surfaces or sides of the paper substrate by applying a surface size composition.

For the purposes of the present invention, the term "paper surface sizing device" refers to those devices, apparatus, machines, etc., which may be used to treat, apply, coat, etc., surface size compositions to one or more surfaces of a paper substrate. Paper surface sizing devices may include air-knife coaters, rod coaters, blade coaters, size presses, dip coaters, slot extrusion coaters, etc. See G. A. Smook, Handbook for Pulp and Paper Technologists ($2^{nd}$ Edition, 1992), pages 283-94, the entire contents and disclosure of which is herein incorporated by reference, for a general description of size presses, coaters, etc., that may be useful herein. Size presses may include a puddle size press, a metering size press, etc. See G. A. Smook, Handbook for Pulp and Paper Technologists ($2^{nd}$ Edition, 1992), pages 283-85, the entire contents and disclosure of which is herein incorporated by reference, for a general description of size presses that may be useful herein.

For the purposes of the present invention, the term "flooded nip size press" refers to a size press having a flooded nip (pond), also referred to as a "puddle size press." Flooded nip size presses may include vertical size presses, horizontal size presses, etc.

For the purposes of the present invention, the term "metering size press" refers to a size press that includes a component for spreading, metering, etc., deposited, applied, etc., the surface size composition on a paper substrate side or surface. Metering size presses may include a rod metering size press, a gated roll metering size press, a doctor blade metering size press, etc.

For the purposes of the present invention, the term "rod metering size press" refers to metering size press that uses a rod to spread, meter, etc., the surface size composition on the paper substrate surface. The rod may be stationary or movable relative to the paper substrate.

For the purposes of the present invention, the term "gated roll metering size press" refers to a metering size press that may use a gated roll, transfer roll, soft applicator roll, etc. The gated roll, transfer roll, soft applicator roll, etc., may be stationery relative to the paper substrate, may rotate relative to the paper substrate, etc.

For the purposes of the present invention, the term "doctor blade metering size press" refers to a metering press which may use a doctor blade to spread, meter, etc., the surface size composition on the paper substrate surface.

For the purposes of the present invention, the term "hydrophobic pigmented coating composition" (also referred interchangeably as a "hydrophobic base coat composition") refers to a coating composition comprising: a paper pigment component; a hydrophobic pigment binder component; etc., as well as one or more optional components such as water-dispersible emulsion polymers (as described below); rheology modifiers; optical brighteners (OBAs); defoamers; dispersants; etc.

For the purposes of the present invention, the term "hydrophobic pigmented coating layer" (also referred interchangeably as a "hydrophobic base coat layer" or "HPC layer") refers to refers to one or more layers formed on (i.e., adjacent to) one or both surfaces of surface size coating layer(s) by applying of a hydrophobic pigment coating composition. Devices which may be use to apply these hydrophobic pigmented coating layers may include one or more of: air-knife coaters, rod coaters, blade coaters, curtain coaters, cascade coaters, dip coaters, slot extrusion coaters, etc.

For the purposes of the present invention, the term "paper pigment component" refers to a paper pigment component comprising: one or more platy mineral pigments; optionally one or more non-platy paper pigments; etc.

For the purposes of the present invention, the term "hydrophobic pigment binder component" refers to a binder component for the pigment component which comprises one or more hydrophobic polymers. These hydrophobic polymers may in the form of a latex, may be homopolymers or copolymers, and may include one or more of: styrene-butadiene (SB) copolymers; styrene-acrylic (SA) copolymers; styrene-acrylic-acrylonitrile (SAN) copolymers; polyvinyl acetate polymers; polyethylene (PE) polymers, including copolymers thereof; polypropylene (PP) polymers, including copolymers thereof, polyethylene terephthalate (PET) polymers, including copolymers thereof; waxes; polyurethane polymers; epoxy resins; etc.

For the purposes of the present invention, the term "moisture barrier coating composition" (also referred to interchangeably as the "topcoat composition") refers to an aqueous emulsion coating composition imparting moisture barrier (hydrophobicity) benefits to the coated paper substrate, and which comprises: one or more water-dispersible emulsion polymers; an aqueous solvent (e.g., water), etc., as well as one or more optional ingredients, such as rheology modifiers, defoamers, coefficient of friction (COF) modifiers, heat-sealing aid, adhesive aids, anti-blocking aids (which may include pigments) for inhibiting the surfaces of coated paper substrates from sticking together (e.g., during pick or pull off on the rollers, during formation into rolls of coated paper substrate, etc.), etc.

For the purposes of the present invention, the term "moisture barrier coating layer" (also referred to interchangeably as a "topcoat layer") refers to one or more outer layers formed from a moisture barrier coating composition, and wherein the one or more outer layers are formed on (i.e., adjacent to) the hydrophobic pigmented coating layer(s) by applying a moisture barrier coating composition. This moisture barrier coating layer may also be heat-sealable so that the resulting moisture barrier coated paper substrate may be used in making, for example, disposable cups, by using, for example, standard heat-seal cup forming equipment.

For the purposes of the present invention, the term "water-dispersible emulsion polymers" refers to polymers or copolymers which are dispersible in aqueous solvents (e.g., water) to form an aqueous polymer emulsion, and which may form a heat-sealable hydrophobic moisture barrier layer when dried (heated). These water-dispersible emulsion polymers should provide polymer particles that coalesce into a continuous film at normal drying temperatures employed in papermaking, should be heat-sealable at temperatures and seal times comparable to or in the range of, for example, low density polyethylene (LDPE), polyethylene terephthalate (PET), etc., should be safe for contact with foods or beverages (for those embodiments of the coated paper substrate to be used with foods or beverages), etc. Water-dispersible emulsion polymers suitable in embodiments of the present invention may include one or more of: polyethylene (PE) polymers (e.g., low density polyethylene (LDPE)), including copolymers thereof; polyethylene terephthalate (PET) polymers, including copolymers thereof; polyhydroxyalkanoate (PHA) polymers; polylactic acid (PLA) polymers; polyglycolic acid (PGA) polymers; polyvinyl acetate polymers; waxes; polyurethane polymers; epoxy resins; etc.

For the purposes of the present invention, the term "polyethylene (PE) polymers" refers to polyethylene (PE) polymers or copolymers which may be 1 density (LDPE) or high density (HDPE), and which may be formed as emulsions for providing the moisture barrier coating layer. Suitable commercially available PE polymer emulsions may include high density polyethylene (HDPE), as well as low density polyethylene (LDPE) emulsions available, for example, Coating X300 from Michelman, MD-80 from Omnova, Berchem 4000 from Bercen, etc.

For the purposes of the present invention, the term "polyethylene terephthalate (PET) polymers" refers to polyethylene terephthalate (PET) polymers or copolymers which may be formed as emulsions for providing the moisture barrier coating layer. Suitable commercially available PET polymer emulsions or modified PET emulsions may include EvCote Water Barrier 3000 from AkzoNobel, SFS 230HS and 250HS from Sustainable Fiber Solutions, etc.

For the purposes of the present invention, the term "polyhydroxyalkanoate (PHA) polymers" refers to biodegradable thermoplastic aliphatic polyesters which may be produced by polymerization of the respective monomer hydroxy aliphatic acids (including dimers of the hydroxy aliphatic acids), by bacterial fermentation of starch, sugars, lipids, etc. PHAs may include one or more of: poly-beta-hydroxybutyrate (PHB) (also known as poly-3-hydroxybutyrate); poly-alpha-hydroxybutyrate (also known as poly-2-hydroxybutyrate); poly-3-hydroxypropionate; poly-3-hydroxyvalerate; poly-4-hydroxybutyrate; poly-4-hydroxyvalerate; poly-5-hydroxyvalerate; poly-3-hydroxyhexanoate; poly-4-hydroxyhexanoate; poly-6-hydroxyhexanoate; polyhydroxybutyrate-valerate (PHBV); etc., including copolymers, blends, mixtures, combinations, etc., of different PHA polymers, etc. PHAs may be synthesized by methods disclosed in, for example, U.S. Pat. No. 7,267,794 (Kozaki et al.), issued Sep. 11, 2007; U.S. Pat. No. 7,276,361 (Doi et al.), issued Oct. 2, 2007; U.S. Pat. No. 7,208,535 (Asrar et al.), issued Apr. 24, 2007; U.S. Pat. No. 7,176,349 (Dhugga et al.), issued Feb. 13, 2007; and U.S. Pat. No. 7,025,908 (Williams et al.), issued Apr. 11, 2006, the entire disclosure and contents of the foregoing documents being herein incorporated by reference.

For the purposes of the present invention, the term "polylactic acid or polylactide (PLA) polymers" refers to biodegradable thermoplastic aliphatic polyesters formed from a lactic acid or a source of lactic acid, for example, renewable resources such as corn starch, sugarcane, etc. The term PLA may refer to all stereoisomeric forms of PLA including L- or D-lactides, and racemic mixtures comprising L- and D-lactides. For example, PLA may include D-polylactic acid, L-polylactic acid (also known as PLLA), D,L-polylactic acid, meso-polylactic acid, as well as any combination of D-polylactic acid, L-polylactic acid, D,L-polylactic acid and meso-polylactic acid. PLA polymers useful herein may have, for example, a number average molecular weight in the range of from about 15,000 and about 300,000. In preparing PLA polymers, bacterial fermentation may be used to produce lactic acid, which may be oligomerized and then catalytically dimerized to provide the monomer for ring-opening polymerization. PLA polymers may be prepared in a high molecular weight form through ring-opening polymerization of the monomer using, for example, a stannous octanoate catalyst, tin(II) chloride, etc.

For the purposes of the present invention, the term "polyglycolic acid or polyglycolide (PGA) polymers" refers to biodegradable thermoplastic aliphatic polyesters which may be prepared from glycolic acid or a source of glycolic acid by polycondensation of glycolic acid, by ring-opening polymerization of glycolide, by solid state polycondensations of halogenoacetates, etc. See description of preparation of PLA polymers above.

For the purposes of the present invention, the term "recyclable" refers to refers to compositions, compounds, substances, materials, paper substrates (e.g., coated paper substrates), etc., which may be reused as is or after reprocessing (e.g., composting, other chemical processing, etc.) in preparing new compositions, compounds, substances, materials, paper substrates, etc. The term "recyclable" includes the term "repulpable."

For the purposes of the present invention, the term "repulpable" refers to compositions, compounds, substances, materials, paper substrates, (e.g., coated paper substrates), etc., which may be reused as is or after reprocessing (e.g., composting, other chemical processing, etc.) in papermaking.

For the purposes of the present invention, the term "calendering" refers to a conventional papermaking process for smoothing out the surface of the material being calendered, e.g., a coated paper substrate. For example, calendering may involve a process of using pressure (and optionally temperature and moisture) for smoothing out a rougher surface. Calendering may be carried out on a calender which may comprise a series of calender rolls at the end of, for example, a papermaking machine (on-line), or separate from the papermaking machine (off-line). Calendering may include supercalendering, hot-soft calendering, moisture-gradient calendering, extended nit calendering, belt calendering, etc. See G. A. Smook, Handbook for Pulp and Paper Technologists ($2^{nd}$ Edition, 1992), pages 273-78, the entire contents and disclosure of which is herein incorporated by reference, for a general description of calendering, as well as devices for carrying out calendering, that may be useful herein.

For the purposes of the present invention, the term "comprising" means various compounds, components, polymers, ingredients, substances, materials, layers, steps, etc., may be conjointly employed in embodiments of the present invention. Accordingly, the term "comprising" encompasses the more restrictive terms "consisting essentially of" and "consisting of."

For the purposes of the present invention, the term "and/or" means that one or more of the various compositions, compounds, polymers, ingredients, substances, materials, layers, steps, etc., may be employed in embodiments of the present invention.

Description

As an alternative to lamination with polyethylene or coating with wax to improve water-repellency and moisture resistance (also referred to herein as "water holdout") of paper substrates, in particular paperboard used as cupstock in making cups used for "hot" or "cold" beverage or food products, the paperboard may be coated with an aqueous polymer emulsion (often referred to as a "topcoat"), such as an aqueous polyethylene terephthalate (PET) emulsion, to provide such water-repellency and moisture resistance. The topcoat formed by such polymer emulsions should desirably provide a smooth surface with sufficient water holdout, also desirably using a minimal amount of such an aqueous polymer emulsion to coat the surface of the paperboard and thus form a continuous hydrophobic moisture barrier layer. This topcoat layer on the paperboard, while providing a moisture barrier layer, should still provide the ability for the coated paperboard to be adhesively connected together (e.g., heat-sealed, glued, etc.) to form, for example, a cup, or similar containers, packaging, etc., formed by using such adhesive connecting of the paperboard.

In providing such a moisture barrier layer with such aqueous polyethylene terephthalate (PET) emulsion topcoats, it also desirable that surface of the paperboard be as smooth as possible. A rougher paperboard surface may require more topcoat formulation to make a continuous film because the topcoat formulation may need to fill in all the depressions, pits, voids, cracks, pores, pinholes, etc., present in the paperboard surface so that the coating is continuous without such depressions, pits, voids, cracks, pores, pinholes, etc., but with a minimal coating thickness to create the moisture (water) barrier. In addition, the paperboard surface itself may require sufficient water holdout. Because the topcoat formulation is an aqueous mixture, the topcoat formulation may also be absorbed into the paperboard if the paperboard surface does not have sufficient water holdout. As a result, more topcoat formulation may need to be applied to the paperboard surface to form a continuous film without such depressions, pits, voids, cracks, pores, pinholes, etc., as well as having the minimal thickness required for creating a moisture (water) barrier to compensate for the topcoat formulation which may be absorbed into the paperboard. Accordingly, treatment of the paperboard surface may be required to minimize the absorption of the topcoat formulation by the paperboard.

In treating the paperboard to inhibit absorption of such topcoat formulations, it is desirable that such treatment may be applied by either a size press and/or paper coater. Such a size press or coating formulation may require sufficient solids and viscosity to work well with the size press and coating equipment common to paperboard machines. It is may also be necessary that the size press and/or coating formulation dry relatively quickly and sufficiently enough so that the coating formed is not picked or pulled off, or become "blocked" (i.e., where the front side of the finished paperboard, after being coated, sticks to the back side thereof) when wound up in a roll at the end of the paperboard-making machine.

One attempted prior solution to this problem involves the use of paperboard (cupstock) with higher levels of internal sizing to provide water holdout. But higher levels of internal sizing alone may not work because the resulting paperboard surface may remain too rough (e.g., Parker Print Smoothness for surface of the finished paperboard is higher than about 3), and may contain too many depressions, pits, voids, cracks, pores, pinholes, etc., which may absorb the topcoat formulation, thus again increasing the amount of topcoat formulation required to achieve a continuous topcoat film free of such depressions, pits, voids, cracks, pores, pinholes, etc., and of sufficient thickness to provide the needed moisture (water) resistance so that, for example, a cup formed from such coated paperboard may contain a "cold" beverage without losing structurally integrity (due to moisture condensation and absorption) and eventually becoming too soft for the user to hold.

Another solution that has been tried is to coat the paperboard with a standard paperboard coating that is formulated for flexo and/or offset printing. But such coatings have been found to provide inadequate water holdout when the aqueous emulsion topcoat is applied by off-machine coating due to the porosity of such coatings which may be necessary for good printability.

Another attempted prior solution to this problem has been to try to coat the prior paperboard with an off-machine coating that is higher in polymer latex content to fill in such depressions, pits, voids, cracks, pores, pinholes, etc., between the coating formulation pigment particles. Such a higher polymer latex coating formulation may work for an off-machine coater, but may also tend to cause "blocking" (as described above) on a paperboard machine due to the higher latex content and higher heat content of the coated paperboard as it is wound up on the reel at the end of the paperboard machine. Instead, the size press or coating formulation should desirably have an appropriate level of solids and viscosity to work well with size press and coating equipment common to paperboard machines. In addition, the size press and/or coating formulation should be able to be dried quickly and sufficiently enough that the formulation does not, for example, pick or pull off on the rollers, or cause "blocking" (as described above).

Other problems with prior moisture resistant hydrophobic coatings for paperboards include these coatings being fairly thick (e.g., on the order of about 0.5 to about 2 mils thick), as well as making the coated paperboards difficult to recycle or even not recyclable, as well as difficult to repulp or even unrepulpable with standard papermaking machinery or equipment. For example, prior coated paperboards having laminated polyethylene (PE) films may be unrepulpable because these laminated polyethylene (PE) film paperboards cannot be ground up in the repulping units, and also do not soften (as do other paper ingredients) when acid or base is added. Because these coated paperboards are often used in making disposable articles, such as beverage cups, food trays, etc., it may be important that the coated paperboards be recyclable, as well as repulpable. That means that the hydrophobic coatings applied to the paperboard to improve water holdout are desirably not only recyclable, but are also repulpable with standard papermaking machinery or equipment which may include size presses, coaters, etc. In addition, the ability to recycle and repulp any scrap generated during manufacture of the coated paperboard is also desirable.

Accordingly, embodiments of the coated paper substrate (e.g., coated paperboard) of the present invention provide improved water holdout for the paperboard, a smoother paperboard surface, a coated paperboard which is resistant to "blocking" on the paperboard machine, etc. Improved water holdout is provided in this coated paperboard by including: (1) a higher level of internal sizing agent in the paper substrate (e.g., paperboard), i.e., sufficient to impart an HST value of at least about 200 seconds; (2) a surface size composition containing one or more surface sizing starches (e.g., ethylated starch, oxidized corn starch, etc.), optionally one or more a non-starch hydrophobic surface sizing agent (e.g., styrene-maleic anhydride (SMA) copolymers, styrene-acrylic (SA) copolymers (e.g., styrene-acrylic acid (SAA) copolymers; alkylated melamines; rosin sizes (e.g., rosin emulsion sizes, rosin soap sizes, etc.); styrene-butadiene (SB) copolymers; acrylonitrile-butadiene (AB) copolymers, alkyl ketene dimers (AKDs), polyacrylamide polymers or copolymers, etc.) to increase hydrophobicity but lower the coat weight of surface size composition required and/or the coat weight of the hydrophobic pigment coating layer required, and optionally one or more paper pigments (e.g., a platy mineral pigment such as clay and/or talc) applied to one or both surfaces of the paper substrate (e.g., paperboard) having a higher level of internal sizing agent; and (3) a hydrophobic pigment coating composition containing a paper pigment component having a higher level of platy mineral pigment (e.g., clay, etc.) and a hydrophobic latex polymer (e.g., a latex comprising styrene-butadiene (SB) copolymer, styrene-acrylic (SA) copolymer, styrene-acrylic-acrylonitrile (SAN) copolymer, etc.). The hydrophobic pigment coating composition (and optionally the surface size composition) provide platy pigment particles which may cover the depressions, pits, voids, cracks, pores, pinholes, etc., in the paper substrate (e.g., paperboard) surface, thus producing a smoother coated paper substrate (e.g., paperboard) surface for the subsequently applied topcoat emulsion formulation after calendering. Calendering may thus compact the combined surface size/hydrophobic pigment coating layers, thereby reducing the porosity of the combined surface size/hydrophobic pigment coating layers, and thus increase both the smoothness and water holdout of the resulting coated paper substrate (e.g., paperboard).

Platy paper pigments such as clay, talc, etc., also provide a tortuous path for water to penetrate which enables the hydrophobic pigment coating composition (and in some embodiments, the surface size composition) to provide improved water holdout. Non-starch hydrophobic surface sizing agents such as styrene-maleic anhydride (SMA) are film forming, and thus may help provide improved water holdout for the surface size composition. Such surface size compositions may be applied with a metered size press, which may provide better holdout for the surface size coating composition on the paper substrate (e.g., paperboard) surface. At higher solids levels (e.g., at solids levels of about 12% or higher in the surface size composition) and at a higher pickup of the surface size composition, the surface size composition may provide better water holdout, keeping the surface size composition nearer the paper substrate (e.g., paperboard) surface, and helping to fill in some of the depressions, pits, voids, cracks, pores, pinholes, etc., on the paper substrate (e.g., paperboard) surface. The hydrophobic (latex) polymer used in the hydrophobic pigment binder component and which is present in the hydrophobic pigment coating composition (and which may be, for example, a styrene-butadiene (SB) copolymer, a styrene-acrylic (SA) copolymer, or a styrene-acrylic copolymer containing acrylonitrile (SAN), such as from about 5 to about 30% of the copolymer being acrylonitrile) may also help to improve the water holdout of the hydrophobic pigment coating composition. Additional water holdout may also be provided by including in the hydrophobic pigment coating composition one or more water water-dispersible emulsion polymers, for example, from about 2 to about 10 parts (solids basis) per of an aqueous polyethylene (PE)-containing emulsion per 100 parts of the paper pigment component. Inclusion of water-dispersible emulsion polymers such as a PE-containing emulsion in the hydrophobic pigment coating composition may help to reduce the capillary absorption of the aqueous emulsion topcoat composition also comprising such water-dispersible emulsion polymers, as well as reducing the tendency of the hydrophobic pigment coating to cause "blocking" (as described above) when reeled up on the papermaking machine as a roll.

Embodiments of the coated hydrophobic paper substrates of the present invention which may achieve these improvements in water holdout, as well as other beneficial properties as described herein comprise a paper substrate having a first surface and a second surface. The paper substrate may be in the form of paperboard (e.g., cupstock) having a thickness from the first to the second surface in the range of from about 8 to about 28 mils, such as from about 12 to about 24 mils. The paper substrate comprises at least about 70% by weight of the paper substrate of paper fibers, for example, at least about 80% by weight paper fibers, such as least about 97% paper fibers. (Other than the internal sizing agent, the balance of the paper substrate besides the paper fibers comprises paper fillers such as calcium carbonate, etc., ash, etc.). The paper fibers may comprise, for example, from about 20 to 100% by weight (such as from about 30 to about 90% by weight) softwood fibers and from 0 to about 80% by weight (such as from about 10 to about 70% by weight) hardwood fibers. The paper fibers may also optionally comprise synthetic (e.g., bicomponent) fibers in an amount of, for example, from about 2 to about 8% by weight, such as from about 4 to about 6% by weight.

The paper substrate further comprises an internal paper sizing agent (as described above) in an amount sufficient to impart to the paper substrate an HST value of at least about 200 seconds, for example, an HST value of from about 200 to about 1000 seconds, such as from about 300 to about 700 seconds. For example, when using a nonreactive internal sizing agent such as a resin emulsion size, rosin soap size, a wax emulsion size, etc., the amount of internal sizing agent may be, for example, in the range of from about 0.2 to about 1.5% by weight of the paper substrate, such as from about 0.5 to about 1% by weight of the paper substrate.

Embodiments of the coated hydrophobic paper substrates of the present invention further comprise a surface size layer on (i.e., adjacent to) one of the first or second surfaces, or in some embodiments, both of the first or second surfaces of the paper substrate. The surface size layer is present in an amount of at least about 1 lbs/3000 $ft^2$ (3 msf) of the paper substrate, for example, from about 1 to about 6 lbs/3 msf of the paper substrate, such as from about 2 to about 4 lbs/3 msf of the paper substrate. The surface size layer comprises one or more surface sizing starches (as described above). The amount of paper surface sizing starches may be, for example, at least about 1 lbs/3000 $ft^2$ (3 msf), such as in the range of from about 1 to about 6 lbs/3 msf (e.g., from about 2 to about 4 lbs/3 msf). In some embodiments, this surface size layer may also have (after, for example, calendering) a paper smoothness value, in terms of Parker Print Smoothness values, of less than about 6, such as less than about 5.

To increase hydrophobicity, as well as lower the coat weight of the surface size layer(s), the surface size layers may further optionally comprising non-starch hydrophobic surface sizing agent (as described above), The non-starch hydrophobic surface sizing agent may be present in the surface sizing layer in an amount of, for example, from about 1 to about 10 parts per 100 parts of the surface sizing starches, such from 2 to about 5 parts per 100 parts of the surface sizing starches. To provide additional smoothness benefits by filling in depressions, pits, voids, cracks, pores, pinholes, etc., the surface size layer may also further comprise one or more paper pigments, e.g., platy mineral pigments such as clay, talc, mica, etc., including mixtures of such platy mineral pigments, e.g., mixtures of clay and talc, as well as non-platy paper pigments such ground calcium carbonate (GCC), precipitated calcium carbonate (PCC), plastic pigments, etc., including mixtures of platy mineral pigments and non-platy paper pigments. These paper pigments may be present in the surface size layer in an amount of from 1 to about 50 parts, such as from 1 to about 30 parts, per 100 parts of the surface sizing starches. The surface size layer (or surface size composition forming such layers) may also further comprise other optional ingredients such as pigment binders, crosslinkers, rheology modifiers, defoamers, etc.

Embodiments of the coated hydrophobic paper substrates of the present invention further comprise at least one hydrophobic pigmented coating layer (e.g., one or two such layers) on (i.e., adjacent to) at least one (i.e., either or both) surface size layer (i.e., one surface size layer or both surface size layers). The at least one hydrophobic coating layer imparts of one, two, or all of the following values: a Cobb value of about 50 gsm or less per 2 minutes, for example, about 45 gsm or less per 2 minutes, such as from about 10 to about 40 gsm per 2 minutes. In some embodiments, the hydrophobic coating layer may also impart an HST value of at least about 500 seconds, for example, from about 500 to about 5000 seconds, such as from about 600 to about 1000 seconds.

After application (and, for example, after calendering), at least one hydrophobic coating layer also has a has a paper smoothness value, in terms of Parker Print Smoothness (PPS) values, of less than about 3, such as less than about 2. In some embodiments, this at least one hydrophobic coating layer (after, for example, calendering) also has a paper smoothness value, in terms of Sheffield Unit (SU) values, of less than about 150, such as less than about 100.

The hydrophobic pigmented coating layer is present on each in a coat weight of from about 2 to about 20 lbs/3000 $ft^2$ (3 msf) of the paper substrate. Where one hydrophobic pigmented coating layer is present on the surface size layer, the coat weight may be in the range of, for example, from about 2 to about 10 lbs/3000 $ft^2$ (3 msf), such as from about 4 to about 10 lbs/3 msf of the paper substrate. When the hydrophobic pigmented coating layer comprises two such coating layers being present on the surface size layer(s), the coat weight may be in the range of, for example, from about 4 to about 20 lbs/3000 $ft^2$ (3 msf) of paper substrate (i.e., from about 2 to about 10 lbs/3000 $ft^2$ (3 msf) per layer applied), such as from about 12 to about 16 lbs/3000 $ft^2$ (3 msf) of the paper substrate) (i.e., from about 6 to about 8 lbs/3000 $ft^2$ (3 msf) per layer applied).

The hydrophobic pigmented coating (HPC) layer comprises a paper pigment component in an amount of from about 20 to about 90% by weight (solids basis), such as from about 50 to about 90% by weight (solids basis), of the HPC layer. This paper pigment comprises from about 20 to 100 parts (such as from about 25 to 100 parts) of a platy mineral pigment (e.g., clay, talc, mica, as well as mixtures thereof, etc.), and which may be the same or different from any optional platy mineral pigment which may be optionally present in the surface size layer, and from 0 to about 80 parts (such as from 0 to about 75 parts) of a non-platy paper pigment (e.g., GCC, PCC, plastic pigment, etc.). The HPC layer further comprises a hydrophobic pigment binder component in an amount of from about 10 to about 400 parts (such as from about 15 to about 100 parts) per 100 parts of the paper pigment component. (For providing a hydrophobic pigmented coating layer for on-machine coatings without causing "blocking, as described above, the hydrophobic pigment binder may be present in an amount of from about 15 to about 50 parts per 100 parts of the paper pigment component.) The hydrophobic pigment binder component comprises one or more hydrophobic polymers (as described above) such as, for example, styrene-butadiene (SB) copolymers; styrene-acrylic (SA) copolymers; styrene-acrylic-acrylonitrile (SAN) copolymers; polyvinyl acetate; etc. In some embodiments, the HPC layer may also further optionally comprise one or more water-dispersible emulsion polymers such as polyethylene (PE) polymers; polyethylene terephthalate (PET) polymers; polyhydroxyalkanoate (PHA) polymers; polylactic acid (PLA) polymers; polyglycolic acid (PGA) polymers; etc., in amounts of from about 1 to about 10 parts (such as from about 2 to about 8 parts) per 100 parts of the paper pigment component in the HPC layer. The inclusion of such water-dispersible emulsion polymers facilitates the adherence of the moisture barrier coating layer to the hydrophobic pigmented coating layer (to thus form a moisture barrier coated paper substrate), as well as further improving the water holdout of the hydrophobic pigmented coating layer against any aqueous fluid present in the moisture barrier coating composition when applied to the hydrophobic pigmented coating layer to form the moisture barrier coating layer. There may also be higher temperature melting particles with lower surface energy present, and so can also be helpful in reducing the tendency of the hydrophobic coating layer to "block" when rolled up at the reel.

In embodiments of the method for preparing the hydrophobic coated paper substrate of the present invention, a paper substrate having first surface and second surface is provided (or formed) comprising the paper fibers, internal paper sizing agent, and other optional ingredients. On one or both of the first and second surfaces may be applied a surface size composition comprising surface sizing starches (as described above), non-starch surface sizing agents (as described above), optionally paper pigments (e.g., platy mineral pigment(s) such clay, talc, mixtures of clay and talc, etc.), as well as other optional ingredients to form on one or both surfaces a surface size layer in the amounts and with the paper smoothness values as described above. The surface size composition may be applied to the surface(s) of the paper substrate by, for example, a paper surface sizing device such as an air-knife coater, rod coater, blade coater, size press, dip coater, slot extrusion coater, etc. On one or both applied surface size layer(s) is also applied a hydrophobic pigmented coating composition comprising the paper pigment component (as described above), the hydrophobic pigment binder component (as described above), optionally any water-dispersible emulsion polymer(s), as well as any other optional ingredients to form one or more hydrophobic pigmented coating layers in the amounts and with the Cobb values (and optionally HST and/or surface free energy values) describe above. The hydrophobic pigmented coating composition may be applied to each applied surface sizing layer by, for example, by an air-knife coater, rod coater, blade coater, curtain coater, cascade coater, dip coater, slot extrusion coater, etc. To achieve the Parker Print Smoothness value of about 3 or less (such as about 2 or less), the hydrophobic pigmented coating (HPC) layer(s) formed may be calendered (as described above). In some embodiments, the resulting hydrophobic coated paper substrate may be rolled up for subsequently conversion by application of a moisture barrier coating composition, or may be immediately converted by applying to one or both surfaces thereof a moisture barrier coating composition to thus form a moisture barrier coated paper substrate (e.g., moisture barrier coated paperboard, such as cupstock) which may then be used to form articles such as cups (e.g., for "hot" or "cold" beverages), food trays, ice cream or yogurt containers, other beverage or food packaging materials, other non-beverage or food packaging materials, etc.

FIG. 1 represents an embodiment of a coated paper substrate according to the present invention, indicated generally as 100. Coated paper substrate 100 comprises a paper substrate (e.g., paperboard), indicated generally as 104, having a first surface 108 and a second surface 112 spaced from first surface 104. Applied on top of first surface 108 is a surface size layer, indicated generally as 116, having an outer surface 120. Applied on top of outer surface 120 is a hydrophobic pigmented coating layer, indicated generally as 124, having an outer surface 128. (In some embodiments, hydrophobic pigmented coating layer 124 may comprise two such sequentially applied layers.) As further shown in FIG. 1, a moisture barrier coating layer, indicated generally as 132, and having outer surface 136 may applied on top of outer surface 128 to form a moisture barrier coated paper substrate, indicated generally as 140.

Figure 2:
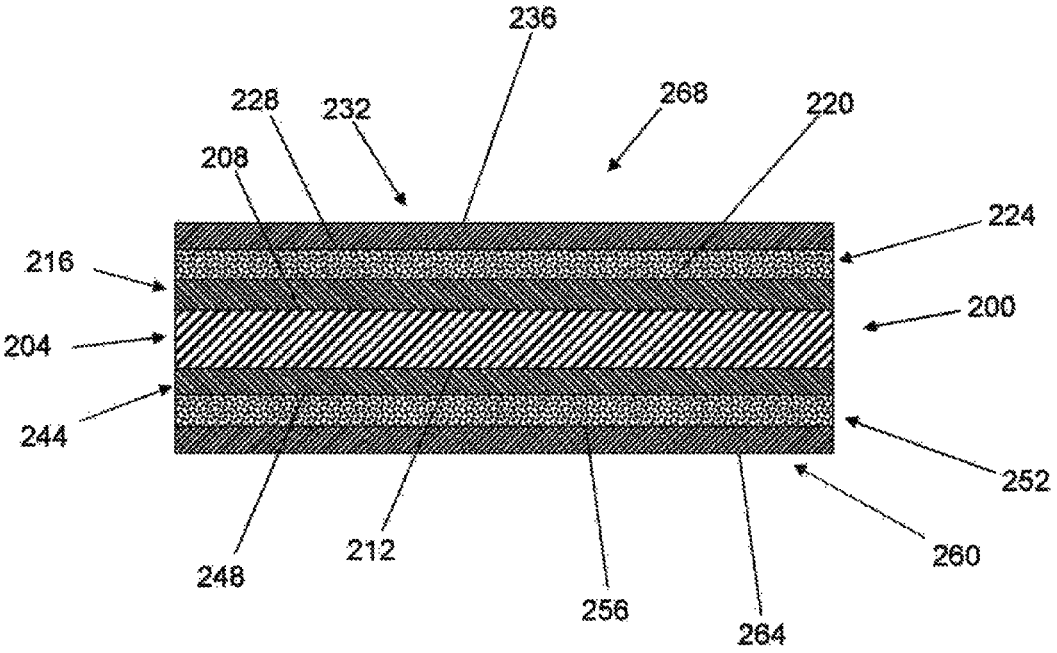
FIG. 2 a sectional view of another embodiment of a hydrophobic coated paper substrate according to the present invention a hydrophobic coated paper substrate, as well as a moisture barrier coated paper substrate according to the present invention having a hydrophobic coating layer/moisture barrier coating layer on both surfaces/sides of the paper substrate.

FIG. 2 represents another embodiment of a coated paper substrate according to the present invention, indicated generally as 200. Coated paper substrate 200 comprises a paper substrate (e.g., paperboard), indicated generally as 204, having a first surface 208 and a second surface 212 spaced from first surface 104. Applied on top of first surface 208 is a first surface size layer, indicated generally as 216, having an outer surface 220. Applied on top of outer surface 220 is a first hydrophobic pigmented coating layer, indicated generally as 224, having an outer surface 228. (In some embodiments, first hydrophobic pigmented coating layer 224 may comprise two sequentially applied layers.) Coated paper substrate 200 further includes a second surface size layer, indicated generally as 244, applied on top of second surface 212 and having an outer surface 248. Coated paper substrate 200 also further includes second hydrophobic pigmented coating layer, indicated generally as 252, applied on top of outer surface 248 and having an outer surface 256. (In some embodiments, second hydrophobic pigmented coating layer 252 may comprise two sequentially applied layers, with first hydrophobic pigmented coating layer 224 comprising either one applied layer or two sequentially applied layers.) As further shown in FIG. 2, a first moisture barrier layer, indicated generally as 232, and having outer surface 236 may applied on top of outer surface 228, as well as a second moisture barrier coating layer, indicated generally as 260, and having outer surface 264 may applied on top of outer surface 256 to form a moisture barrier coated paper substrate, indicated generally as 268. Embodiments of moisture barrier coated paper substrate 268 may be used, for example, as cupstock for "cold" beverages to avoid having the cup formed from such cupstock potentially suffer loss of structural integrity due to condensation which may form on the first or second moisture barrier coating layer 232 or 260 which is not adjacent to the "cold" beverage. (In some embodiments of moisture barrier coated paper substrate 268, such as cupstock used for "hot" beverages, one of the first or second moisture barrier coating layers 232 or 260 may be omitted. In some embodiments of moisture barrier coated paper substrate 268, such as packaging for ice cream, moisture barrier coating layer 232 and pigmented hydrophobic coating layer 224 may be replaced with either one applied layer or two sequentially applied layers of a printable pigmented coating.)

Figure 3:
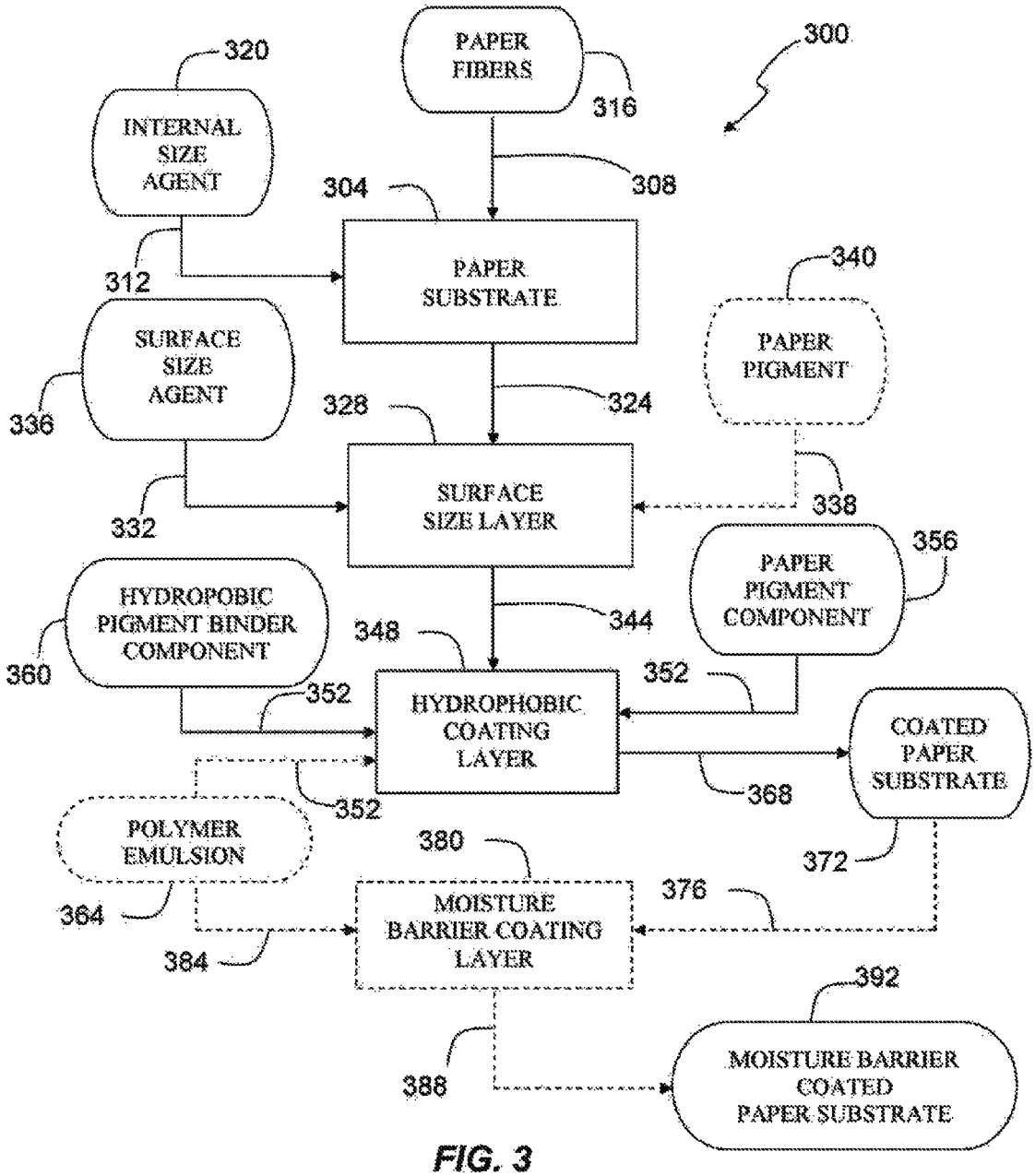
FIG. 3 is a flowchart to illustrate an embodiment of a method for preparing hydrophobic coated paper substrates, as well as moisture barrier coated paper substrates according to the present invention.

FIG. 3 represents a flowchart to illustrate an embodiment of a method for preparing the coated paper substrates according to the present invention, which is generally indicated as 300. As shown in FIG. 3, an internally sized Paper Substrate 304 (e.g., paperboard) is formed in an initial step by combining together, as indicated by arrows 308 and 312, Paper Fibers 316 and Internal Size Agent 320. In the next step, as indicated by arrow 324, a Surface Size Layer 328 is formed one or both surfaces of Paper Substrate 304 by applying, for example, through a size press, a surface size composition (indicated as arrow 332) which comprises one or more surface sizing starches, and optionally one or more non-starch surface sizing agents (collectively indicated as Surface Size Agent 336). As indicated by dotted arrow 338, in some embodiments, the surface size composition 332 may further optionally comprise Paper Pigment (e.g., platy mineral pigment(s) such as clay and/or talc, with or without non-platy paper pigments such as GCC, PCC, etc.), as indicated by dotted oval 340. In the next step, as indicated by arrow 344, a Hydrophobic (Pigmented) Coating Layer 348 is formed on one or both surfaces of Surface Size Coating Layer(s) 328 by applying a hydrophobic pigmented coating composition (indicated by arrows 352) comprising Paper Pigment Component 356 and Hydrophobic Pigment Binder Component 360. As also shown, and as indicated by dotted oval 364, in some embodiments, hydrophobic pigmented coating composition 352 may further comprise Polymer Emulsion 364. As indicated by arrow 368, with the formation of Hydrophobic Coating Layer(s) 348 in step 344, the resulting finished product is provided as Coated Paper Substrate (e.g., coated paperboard) 372. (In some embodiments, Coated Paper Substrate 372 may also be subjected to a calendering step (not shown) to achieve the desired degree of Parker Print Smoothness for each outer surface of Hydrophobic Coating Layer(s) 348.) In a subsequent step indicated by dotted line 376, a Moisture Barrier Coating Layer 380 may be formed on one or both of the outer surfaces of Hydrophobic Coating Layer(s) 348 by applying, as indicated by dotted arrow 384, a moisture barrier coating composition which comprises Polymer Emulsion (indicated by dotted oval 364) to thus form, as indicated by dotted arrow 388, Moisture Barrier Coated Paper Substrate (indicated by dotted oval 392).

EXAMPLES

Coated paper substrates, (e.g., paperboards having a caliper of 12 or 24 points and basis weights 257 or 165) are formed as follows: The Control (C) sample is a commercially available 24 point coated paperboard having a 12-16 lbs/3 msf coat weight of a conventional pigmented coating designed for use with paper substrates used in offset and flexographic printing. Samples S-1 and S-2 use a commercially available 14 point uncoated cupstock having a size press layer containing starch size. Hydrophobic coating formulations (as shown in the Table 1 below) are coated onto this uncoated cupstock using a wire wound rod and is then dried in a forced air oven at a temperature of 110° C. for 2 minutes. The resulting hydrophobic pigment coating (HPC) layers have a coat weight 10 lbs/3 msf. A moisture barrier coating layer is then applied to these HPC layers, also using a wire wound rod, from a commercially available polyethylene terephthalate (PET) emulsion coating (Sustainable Fiber Solutions, SFS coating 230HS). Sample S-3 and Sample S-4 also use this commercially available 14 point uncoated cupstock. The hydrophobic coating formulations (as shown in the Table 1 below) are coated onto this uncoated cupstock using at the rate of 1300 feet per minute (fpm) using a blade coater in the bent blade mode and dried using an infrared (IR) dryer, followed by a forced air oven. The resulting hydrophobic pigment coating (HPC) layers have a coat weight 8 lbs/3 msf. Similar to Samples S-1 and S-2, a moisture barrier coating layer is then applied to these HPC layers, also using a wire wound rod, from a commercially available polyethylene terephthalate (PET) emulsion coating (Sustainable Fiber SOLUTIONS, either SFS coating 230HS or SFS coating 250HS).

The components, layers, and properties of these coated paper substrates are shown in Table 1 below:

TABLE 1

| | Control (C) | Sample S-1 | Sample S-2 | Sample S-3 | Sample S-4 |
|---|---|---|---|---|---|
| Paper Substrate | | | | | |
| Caliper (points) | 24 | 14 | 14 | 14 | 14 |
| Basis Weight[1] | 257 | 165 | 165 | 165 | 165 |
| Size Press Layer[2] | | | | | |
| Starch | 100 | 100 | 100 | 100 | 100 |
| Coat Weight[2] | 2 | 2 | 2 | 2 | 2 |
| HPC[3] Layer | | | | | |
| GCC[4] | | | 100[5] | | 40[6] |
| Platy Clay Pigment | | 100[7] | | 100[8] | 60[8] |
| Latex[9] | | 100[10] | 100[10] | 35[11] | 18[12] |
| PE Emulsion[13] | | | | 5[13] | |
| Coat Weight[1] | 12-16[14] | 10 | 10 | 8 | 8 |
| Moisture Barrier Coating (MBC) Layer | | | | | |
| Coat Weight[1] | 1.2[15] | 2.4[15] | 2.4[15] | 1.2[15] | 1.2[16] |
| Cobb value (gsm per 30 min) | 115 | 10 | 8 | 12 | 16 |

[1]In lbs/3msf
[2]Amounts (estimated) in parts
[3]Hydrophobic Pigmented Coating, amounts in parts
[4]Ground calcium carbonate
[5]From Omya, contains Hydrocarb 60, which is a coarsely ground GCC
[6]From Omya, contains both Hydrocarb 90 GCC (12 parts), which is a finely ground GCC, and Hydrocarb 60 (28 parts)
[7]From KaMin, Hydrafine 90W, which is a medium diameter platy clay
[8]From KaMin, Hydrogloss 91W, which is a smaller diameter platy clay
[9]Pigment binder
[10]From Trinseo, RAP830, which is a styrene-acrylic acid copolymer latex.
[11]From Trinseo, XU30903.5, which is a styrene-butadiene copolymer latex
[12]From Trinseo, RAP810, which a styrene-acrylic acid copolymer latex having a lower Tg than RAP830
[13]From Omnova, MD 80, which is a non-ionic emulsion of low density polyethylene
[14]Coating used for Everest ® paperboard, coat weight estimated
[15]Aqueous heat sealable coating from Sustainable Fiber Solutions (SFS), grade 230HS, which is heat-sealable
[16]Aqueous heat sealable coating from Sustainable Fiber Solutions (SFS), grade 250HS, which is also heat-sealable The results from Table 1 show that the moisture barrier coated (MBC) paperboard samples S-1 through S-4 having a hydrophobic pigmented coating (HPC) layer, and which are embodiments according to the present invention, have significantly lower Cobb values (per 30 minutes) compared to the Control coated paperboard which does not have a HPC layer, but instead a pigmented coating designed for good printability. Also, in view these lower Cobb values, while samples S-1 through S-4 have lower coat weights (8 and 10 lbs/3 msf) for the HPC layer, these samples still achieved greater moisture barrier inhibition relative to the Control coated paperboard which has a higher coat weight (estimated to be in the range of 12-16 lbs/3 msf) for the pigmented coating layer.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. An article comprising a hydrophobic coated paper substrate comprising:

a paper substrate having a first surface and a second surface, the paper substrate comprising:

at least about 70% by weight of the paper substrate of paper fibers; and an internal paper sizing agent in an amount sufficient to impart to the paper substrate an HST value of at least about 200 seconds; and a surface size layer on at least one of the first and second surfaces, the surface size layer being present in an amount of at least about 1 lbs/3000 $ft^2$ (3 msf) of the paper substrate and comprising one or more surface sizing starches in an amount of at least about 1 lbs/3000 $ft^2$ (3 msf);

at least one hydrophobic pigmented coating layer on at least one surface size layer to impart a Cobb value of about 50 gsm or less per 2 minutes; the hydrophobic pigmented coating layer having a Parker Print Smoothness value of less than about 3, and being present on at least one surface size layer in a coat weight of from about 2 to about 20 lbs/3000 $ft^2$ (3 msf) of the paper substrate, the hydrophobic pigmented coating layer comprising:

a paper pigment component in an amount of from about 20 to about 90% by weight of the hydrophobic pigmented coating layer and comprising from about 20 to 100 parts by weight of a platy mineral pigment and from 0 to about 80 parts by weight of a non-platy paper pigment; and a hydrophobic pigment binder component in an amount of from about 10 to about 400 parts per 100 parts of the paper pigment component, the hydrophobic pigment binder component comprising one or more hydrophobic polymers.

2. The article of claim 1, wherein the paper substrate comprises paperboard having a caliper in the range of from about 8 to about 28 mils.

3. The article of claim 2, wherein the caliper is in the range of from about 12 to about 24 mils.

4. The article of claim 2, wherein the paperboard is in the form of cupstock.

5. The article of claim 1, wherein the surface size layer is on only one of the first and second surfaces.

6. The article of claim 1, wherein the surface size layer is on both the first and second surfaces.

7. The article of claim 1, wherein the surface sizing starches are in an amount of from about 1 to about 6 lbs/3000 $ft^2$ (3 msf) and comprise one or more of: unmodified natural starches; ethylated starches; or oxidized starches.

8. The article of claim 1, wherein the surface size layer further comprises one or more non-starch hydrophobic sizing agents are in an amount of from about 1 to about 10 parts per 100 parts of the surface sizing starches.

9. The article of claim 8, wherein the non-starch the non-starch hydrophobic surface sizing agents comprise one or more of: styrene-maleic anhydride (SMA) copolymers; styrene-acrylic acid (SAA) copolymers; alkylated melamine; rosin sizes; styrene-butadiene (SB) copolymers; acrylonitrile-butadiene (AB) copolymers; alkyl ketene dimers (AKDs); or polyacrylamide polymers or copolymers.

10. The article of claim 1, wherein the surface size layer further comprises one or more paper pigments in an amount of from about 1 to about 50 parts per 100 parts of the surface sizing starches.

11. The article of claim 10, wherein the paper pigments of the surface size layer are in an amount of from about 1 to about 30 parts per 100 parts of the surface sizing starches, the paper pigments comprising one or more of: platy mineral pigments; or non-platy paper pigments.

12. The article of claim 11, wherein the platy mineral pigments of the surface size layer comprises one or more of: clay; or talc.

13. The article of claim 1, wherein the platy mineral pigment of the paper pigment component comprises one or more of: clay; or talc, and wherein the non-platy paper pigment of the paper pigment component comprises one or more of: ground calcium carbonate (GCC); or precipitated calcium carbonate (PCC).

14. The article of claim 1, wherein the hydrophobic polymers comprise one or more of: styrene-butadiene (SB) copolymers; styrene-acrylic (SA) copolymers; styrene-acrylic-acrylonitrile (SAN) copolymers; or polyvinyl acetate polymers.

15. The article of claim 14, wherein the paper pigment component is in an amount of from about 50 to about 90% by weight of the hydrophobic pigmented coating layer, and wherein the hydrophobic pigment binder component is in an amount of from about 15 to about 100 parts per 100 parts of the paper pigment component.

16. The article of claim 1, wherein the hydrophobic pigmented coating layer further comprises one or more water-dispersible emulsion polymers in an amount of from about 1 to about 10 parts per 100 parts of the paper pigment component.

17. The article of claim 1, wherein the hydrophobic pigmented coating layer has a coat weight in the range of from about 4 to about 10 lbs/3000 $ft^2$ (3 msf).

18. The article of claim 1, wherein the hydrophobic pigmented coating layer comprises two applied coating layers, and wherein each applied coating layer has a coat weight in the range of from about 6 to about 8 lbs/3000 $ft^2$ (3 msf).

19. The article of claim 1, wherein the hydrophobic pigmented coating layer has a Sheffield Unit smoothness value of less than about 150, and a Cobb value of about 45 gsm or less per 2 minutes.

20. The article of claim 1, wherein the coated paper substrate further comprises a moisture barrier coating layer on least one of the hydrophobic pigmented coating layers, the moisture barrier coating layer comprising one or more water-dispersible emulsion polymers.

21. The article of claim 20, wherein the moisture barrier coating layer is on each of the hydrophobic pigmented coating layers.

22. The article of claim 20, wherein the water-dispersible emulsion polymers comprise one or more of: polyethylene (PE) polymers; polyethylene terephthalate (PET) polymers; polyhydroxyalkanoate (PHA) polymers; polylactic acid (PLA) polymers; polyglycolic acid (PGA) polymers; polyvinyl acetate polymers; waxes; polyurethane polymers; or epoxy resins.

23. The article of claim 1, wherein the paper substrate comprises at least about 95% paper fibers.

24. A method for preparing a hydrophobic coated paper substrate, which comprises the following steps:

(a) providing a paper substrate having a first surface and a second surface, at least one of the first and second surfaces having a surface size layer in an amount of at least about 1 lbs/3000 $ft^2$ (3 msf) of the paper substrate, the paper substrate comprising:

at least about 70% by weight of the paper substrate of paper fibers; and an internal paper sizing agent in an amount sufficient to impart to the paper substrate an HST value of at least about 200 seconds;

the surface size layer comprising one or more surface sizing starches in an amount of at least about 1 lbs/3000 $ft^2$ (3 msf); and (b) applying a hydrophobic pigmented coating composition to at least one surface size layer to form at least one hydrophobic pigmented coating layer having a Parker Print Smoothness value of less than about 3 on the surface size layer and a Cobb value of about 50 gsm or less per 2 minutes, the hydrophobic pigmented coating composition being applied in a coat weight of from about 2 to about 20 lbs per 3000 $ft^2$ (3 msf) of the paper substrate, the hydrophobic pigmented coating composition comprising:

a paper pigment component in an amount of from about 20 to about 90% by weight in the hydrophobic pigmented coating composition, and comprising from about 20 to 100 parts by weight of a platy mineral pigment and from 0 to about 80 parts by weight of a non-platy paper pigment; and a hydrophobic pigment binder component in an amount of from about 10 to about 400 parts per 100 parts of the paper pigment component, the hydrophobic pigment binder component comprising one or more hydrophobic polymers.

25. The method of claim 24, wherein step (a) is carried out by applying a surface size composition comprising the surface sizing starches to the at least one of the first and second surfaces with a size press to form the surface size layer.

26. The method of claim 25, wherein step (a) is carried out by applying the surface size composition in an amount of from about 1 to about 6 lbs/3000 $ft^2$ (3 msf) to each of the first and second surfaces with the size press to form the surface size layer on each of the first and second surfaces.

27. The method of claim 26, wherein step (b) is carried out by applying the hydrophobic pigmented coating composition to each surface size layer to form the hydrophobic pigmented coating layer on each surface size layer.

28. The method of claim 25, wherein the surface size composition further comprises one or more non-starch hydrophobic sizing agents are in an amount of from about 1 to about 10 parts per 100 parts of the surface sizing starches, the non-starch hydrophobic surface sizing agents comprising one or more of: styrene-maleic anhydride (SMA) copolymers; styrene-acrylic acid (SAA) copolymers; alkylated melamine; rosin sizes; styrene-butadiene (SB) copolymers; acrylonitrile-butadiene (AB) copolymers; alkyl ketene dimers (AKDs); or polyacrylamide polymers or copolymers.

29. The method of claim 25, wherein the surface size composition further comprises one or more paper pigments in an amount of from about 1 to about 50 parts per 100 parts of the surface sizing starches, the paper pigments comprising one or more of: clay, or talc.

30. The method of claim 24, wherein step (b) is carried out by applying the hydrophobic pigmented coating composition to the surface size layer as two sequentially applied hydrophobic pigmented coating layers, each of the sequentially applied hydrophobic pigmented coating layers being in a coat weight in the range of from about 4 to about 10 lbs/3000 $ft^2$ (3 msf).

31. The method of claim 24, wherein platy mineral pigment of the paper pigment component step (b) comprises one or more of: clay; or talc, and wherein the non-platy paper pigment of the paper pigment component comprises one or more of: ground calcium carbonate (GCC); or precipitated calcium carbonate (GCC), and wherein the hydrophobic polymers of step (b) comprise one or more of: styrene-butadiene (SB) copolymers; styrene-acrylic (SA) copolymers; styrene-acrylic-acrylonitrile (SAN) copolymers; or polyvinyl acetate polymers.

32. The method of claim 31, wherein the paper pigment component is in an amount of from about 50 to about 90% by weight of the hydrophobic pigmented coating composition of step (b), and wherein the hydrophobic pigment binder component is in an amount of from about 15 to about 100 parts per 100 parts of the paper pigment component.

33. The method of claim 31, wherein the hydrophobic pigmented coating composition of step (b) further comprises one or more water-dispersible emulsion polymers in an amount of from about 1 to about 10 parts per 100 parts of the paper pigmented component, the water-dispersible emulsion polymers comprising one or more of: polyethylene (PE) polymers; polyethylene terephthalate (PET) polymers.

34. The method of claim 24, which comprises the further step of: (c) calendering the hydrophobic coated paper substrate after step (b) so that the at least one hydrophobic pigmented coating layer has a Parker Print Smoothness value of less than about 3 and so that the surface size layer has a Parker Print Smoothness value of less than about 3.

35. The method of claim 34, wherein the calendering during step (c) is carried so that the at least one hydrophobic pigmented coating layer has a Parker Print Smoothness value of less than about 2 and so that the surface size layer has a Parker Print Smoothness value of less than about 5.

36. The method of claim 34, further comprising the step of: (d) applying on least one of the hydrophobic pigmented coating layers a moisture barrier coating composition to form a moisture barrier coating layer, the moisture barrier coating composition comprising one or more of: polyethylene (PE) polymers; polyethylene terephthalate (PET) polymers; polyhydroxyalkanoate (PHA) polymers; polylactic acid (PLA) polymers; polyglycolic acid (PGA) polymers; polyvinyl acetate polymers; waxes; polyurethane polymers; or epoxy resins.

37. The method of claimed 24, wherein the paper substrate of step (a) comprises paperboard having a caliper in the range of from about 14 to about 24 mils.

* * * * *